US005813068A

United States Patent [19]

Reinehr et al.

[11] Patent Number: 5,813,068

[45] Date of Patent: Sep. 29, 1998

[54] APPARATUS AND A PROCESS FOR WASHING CONTINUOUSLY WET-SPUN ELASTANE

[75] Inventors: Ulrich Reinehr; Günter Türck, both of Dormagen; Tilo Sehm, Düsseldorf; Wolfgang Anderheggen; Toni Herbertz, both of Dormagen, all of Germany; Gino Antolini, Bergamo, Italy

[73] Assignee: Bayer Faser GmbH, Dormagen, Germany

[21] Appl. No.: 572,991

[22] Filed: Dec. 15, 1995

[30] Foreign Application Priority Data

Dec. 23, 1994 [DE] Germany ..... 44 46 340.5

[51] Int. Cl.[6] ..... D06B 3/04

[52] U.S. Cl. ..... 8/151.2; 68/205 R; 68/200; 264/198

[58] Field of Search ..... 8/151.2; 264/198, 264/211.13, 211.14, 211.16, 211.18; 68/205 R, 200

[56] References Cited

U.S. PATENT DOCUMENTS

| | | | |
|---|---|---|---|
| 256,923 | 5/1882 | Picard | 8/151.2 |
| 2,115,132 | 4/1938 | Alles et al. | 264/198 |
| 2,271,932 | 2/1942 | Atkinson | 264/198 |
| 2,558,732 | 7/1951 | Cresswell | 8/151.2 |
| 2,788,256 | 4/1957 | Allen | 264/198 |
| 2,979,767 | 4/1961 | Fry, Jr. | 264/198 |
| 3,139,467 | 6/1964 | Srisch et al. | 264/198 |
| 3,434,913 | 3/1969 | Bockno et al. | 264/198 |
| 3,526,689 | 9/1970 | Jones, Jr. et al. . | |
| 3,620,775 | 11/1971 | Cohly et al. | 264/198 |
| 4,328,838 | 5/1982 | Asada et al. | 264/198 |

FOREIGN PATENT DOCUMENTS

| | | | |
|---|---|---|---|
| 799821 | 6/1936 | France | 8/151.2 |
| 767434 | 6/1952 | Germany | 264/198 |
| 35126 | 11/1934 | Netherlands | 264/198 |
| 499671 | 1/1929 | U.S.S.R. | 264/198 |
| 661098 | 11/1951 | U.S.S.R. | 8/151.2 |

OTHER PUBLICATIONS

EPO 47911, Mar. 1982.

*Primary Examiner*—Frankie L. Stinson
*Attorney, Agent, or Firm*—Sprung Kramer Schaefer & Briscoe

[57] ABSTRACT

This invention relates to a new washing apparatus for the continuous production of elastane filaments which are produced by a wet-spinning process, which essentially consists of a stripping unit (10) and a washing unit (11) which are disposed in steps above the precipitation bath (1) of a wet-spinning device.

10 Claims, 3 Drawing Sheets

APPARATUS AND A PROCESS FOR WASHING CONTINUOUSLY WET-SPUN ELASTANE

This invention relates to a new washing apparatus for the continuous production of elastane filaments which are produced by a wet-spinning process.

BACKGROUND OF THE INVENTION

Elastane filaments are mainly spun by dry- and wet-spinning processes. Whereas in the dry-spinning process the spinning solvent, for example dimethyl acetamide, is removed almost completely by hot gas in the spinning shaft and by high shaft temperatures, in the case of the wet-spinning process the spinning solvent has to be removed by washing with water and subsequent drying and fixing. As a rule, a plurality of washing baths with deflection rollers and pins for guiding the filaments are necessary downstream of the spinning bath in what is termed the filament warp process, in order to remove the major part of the spinning solvent from the filaments. These so-called extraction baths are mostly operated with counter-current flow, for enhanced of the solvent (see F. Fourné, Chemiefasern/Textilindustrie [Chemical Fibres/Textile Industry] 44/96, 1994 Volume Year page 394).

In general, a plurality of extraction baths is employed, the number of which depends on various factors, as mentioned in German Offenlegungsschrift [Patent laid open to public inspection] DE 1 660 141 A1, at the top of page 4. Examples of such factors include the desired content of residual solvent in the filaments, the bath temperature and the spinning rate.

In another wet-spinning process which has become known, washing is effected in a washing bath provided with rollers, by multiple looping of the filaments over the rollers. This process, which is described in U.S. Pat. No. 3,529,689, column 4, Example 1, has also achieved industrial importance. The object of all known washing processes is to keep the amount of solvent which is dragged out with the filaments from the precipitation bath low and to achieve a high wash-out effect of the spinning solvent. U.S. Pat. No. 2,786,737, for example, mentions these advantages, which are in this case obtained by means of a spinning process for cellulose acetate which runs upwards from below. The filaments can be wound more easily, the filament running lengths are shorter and solvent losses are reduced. The object of the present invention is to provide a suitable apparatus for the washing process in the wet-spinning of elastane filaments, by means of which both a significant reduction is obtained in the amount of solvent and the amount of liquid dragged out, and a significantly improved wash-out of the spinning solvent is obtained in the washing bath, compared with the known apparatuses. In addition to the aforementioned economic advantages, environmental advantages can also be anticipated, since a greater proportion of solvent can be fed to a direct solvent recovery stage.

A further significant point is the running behaviour of the elastane filaments during the spinning and washing process. If it is not possible to reduce the moisture and residual solvent content in the continuous overall process before the filaments are fixed, this leads to significant winding defects and breaks during fixing, as has already been mentioned in U.S. Pat. No. 2,786,737.

SUMMARY OF THE INVENTION

It has been found that by the simultaneous combination of a plurality of new constructional details of the washing section in the washing process the mode of running of the filaments is significantly improved, and the residual solvent content in wet-spun filaments can surprisingly be reduced by more than 30%, preferably by 50% or more, compared with the prior art.

This invention relates to an apparatus for washing elastane filaments as part of a continuous wet-spinning device comprising a wet-spinning unit, a washing section, and an after-treatment section, consisting of at least one stripping unit comprising a deflection roller, a squeezing roller and a scraper, and a washing unit comprising washing rollers, a washing vat and an additional squeezing roller, wherein the stripping unit and the washing unit are disposed in steps above the precipitation bath of the wet-spinning device and the elastane filaments leaving the precipitation bath are fed to the washing unit via the stripping unit and thence are fed to the further after-treatment section, which preferably consists of a fixer, a drier, a preparation point and a winding device.

By mounting the deflection roller at the end of the precipitation bath just above the precipitation bath liquid, instead of immersing the deflection roller as is known in the prior art, a large part of the precipitation bath liquid and solvent dragged out with the elastane filaments flows back into the precipitation bath. This procedure is significantly assisted again by the squeezing roller, which removes additional water from the elastane filament warp on the deflection roller. The scraper on the deflection roller also prevents a complete film of liquid from forming on the deflection roller. The moisture and spinning solvent contents of the freshly spun elastane filaments, which are already significantly reduced by the said construction, are further reduced by the additional squeezing roller, which is pressed on to the upper washing roller of the washing bath. The width of the squeezing roller is preferably designed so that it only squeezes those filaments which leave the upper washing roller in the direction of the after-treatment section, e.g. towards the fixer. Both squeezing rollers preferably consist of a rubber material with a Shore hardness of 60 to 80.

Further preferred constructional forms of the invention follow from the subsidiary claims.

DETAILED DESCRIPTION OF THE INVENTION

Without the squeezing roller, a continuous mode of operation is impossible anyway over an extended period at the preferred higher pull-off speed of 100 m/min or more, because the filaments constantly break in the after-treatment section during the subsequent fixing process as a result of moisture and residual solvent contents which are too high. What are termed "dancing filament warps" and an erratic mode of running of the elastane filaments are observed in this situation. In one particular embodiment of the invention, the upper squeezing roller may optionally be designed so that it presses against the upper washing roller over the entire length of the latter. However, it has been shown that this elongated form of squeezing roller can only be used at spinning speeds up to about 80 m/min, as against which a squeezing roller which has a width which is designed so that it only presses against the filaments which leave the washing bath in the direction of the fixing step, can be used universally.

It is only the implementation of all four constructional features together which leads to a good continuous mode of running and to the surprisingly high wash-out effect with a reduction of residual solvent of at least 30%, preferably 50% or more, compared with a spinning and washing process without these measures applied to the elastane filaments running into the after-treatment section.

The use of squeezing rollers in particular has proved to be very effective.

This invention also relates to a process for washing elastane filaments from a continuous wet-spinning process using the apparatus according to the invention, characterised in that freshly wet-spun elastane filaments are pulled off at a pull-off speed of at least 50 m/min and are substantially freed, on the stripping unit, from adhering water which is dragged out of the precipitation bath, wherein stripped-off water flows back into the precipitation bath, and are freed from at least 30% of the spinning solvent by multiple immersions in the washing liquid at a temperature of at least 90° C. in the subsequent washing unit comprising at least one pair of washing rollers, a washing vat and an additional squeezing roller.

DETAILED DESCRIPTION OF THE FIGURES

The invention is described below in detail by way of example and with reference to the Figures, where:

Figure 1:
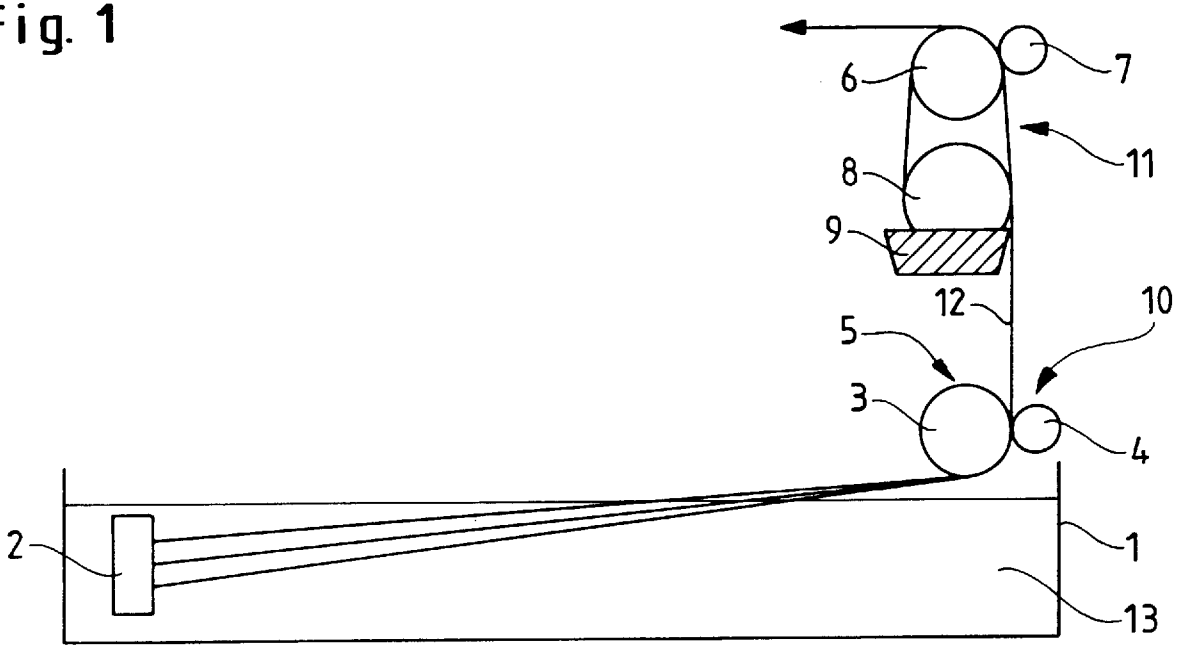
FIG. 1 is a diagrammatic view of the washing apparatus according to the invention.

The following examples serve to explain the invention in detail, without the invention being restricted thereto. Percentages are expressed as percentages by weight unless expressly indicated otherwise.

EXAMPLE 1

A 30% elastane spinning solution prepared according to Example 7 of German Offenlegungsschrift DE 42 22 772, which had been pre-treated with 0.8% diethylamine for about 10 minutes at 130° C. and which had a spinning viscosity of 21 Pa.s at 70° C., was spun from a 60-orifice spinneret into a precipitation bath containing 20% dimethyl acetamide (DMAC). The filaments were pulled off via the deflection roller 3, which was situated above the precipitation bath liquid 13, at 52 m/min, were coalesced, were pressed against by the squeezing roller 4, and the liquid film on the deflection roller 3 was taken off by the rubber scraper 5. The twisted fibres 12 were then washed in the washing bath 9 by looping them 6 times round the two washing rollers 6 and 8, corresponding to a total residence time of about 5.9 seconds. After the completion of the laying-down operation, the upper squeezing roller 7, which only presses against the elastane filaments which leave the washing roller in the direction of after-treatment, particularly towards the fixing step, was placed against the upper washing roller 6. The contact pressure of the squeezing roller 7, which was 5 cm wide, was 10N. The washing bath temperature was 94° C. Both squeezing rollers 4 and 7 had a Shore hardness of 70 and a contact pressure of 2N per cm of roller width. The contact pressure could be regulated by applying different counter-weights. The twisted filament, which had a titre of 545 dtex, had a moisture content of about 74% and a residual DMAC content of around 12.9%, with respect to solid elastane. A perfect continuous wet-spinning process, which proceeded rapidly and with reliability of operation, was maintained for several days.

EXAMPLE 2 (COMPARISON)

The elastane spinning solution from Example 1 was spun as described there, except that the deflection roller 3 was just in contact with the surface of the precipitation bath 1, and the rubber scraper 5 and the squeezing rollers 4 and 7 were omitted. The twisted filaments were washed as described in Example 1, and the titre, moisture content and residual DMAC content of the filaments was then determined. The titre was 548 dtex, the moisture content was 107% and the residual DMAC content was 18.7%. The mode of running of the filaments was erratic. So-called "dancing filament warps" were observed in the fixing zone. Continuous running was not possible over an extended period of time at the comparatively high pull-off speed. There was a high incidence of filament breakage in the fixing zone immediately after laying down the twisted filament.

Figure 2:
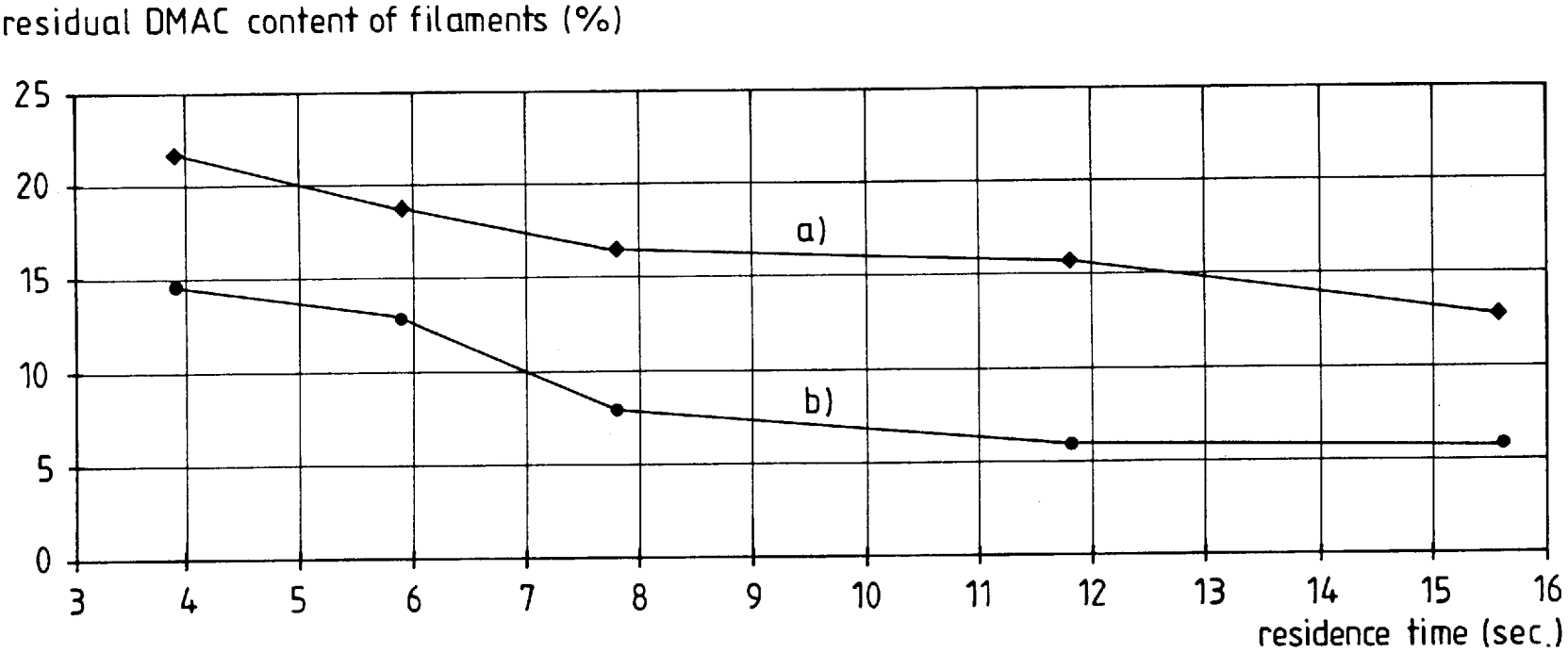
FIG. 2 shows the residual solvent content (of dimethyl acetamide) of elastane filaments produced by the conventional wet-spinning process and by the wet-spinning process according to the invention, as a function of the residence time in seconds.

FIG. 2 shows the residual DMAC contents in elastane filaments with a titre of 550 dtex at a washing temperature of 95° C. as a function of various residence times in the washing bath, which can be adjusted via the number of times the elastane filaments are looped round the washing rollers. FIG. 2*a* relates to the conventional procedure according to the prior art, and FIG. 2*b* relates to the process according to the invention. The residual DMAC content in the elastane filaments refers to the solid substance. As can be seen from FIG. 2, the residual DMAC content in elastane filaments can be reduced by 30% or more, depending on the residence time, by the measures according to the invention. Thus, for example, at a residence time of 15.6 seconds in the washing bath the residual DMAC content of 550 dtex elastane filaments is 12.65% without employing the washing section according to the invention, and is only 5.8% when employing the washing section.

Figure 3:
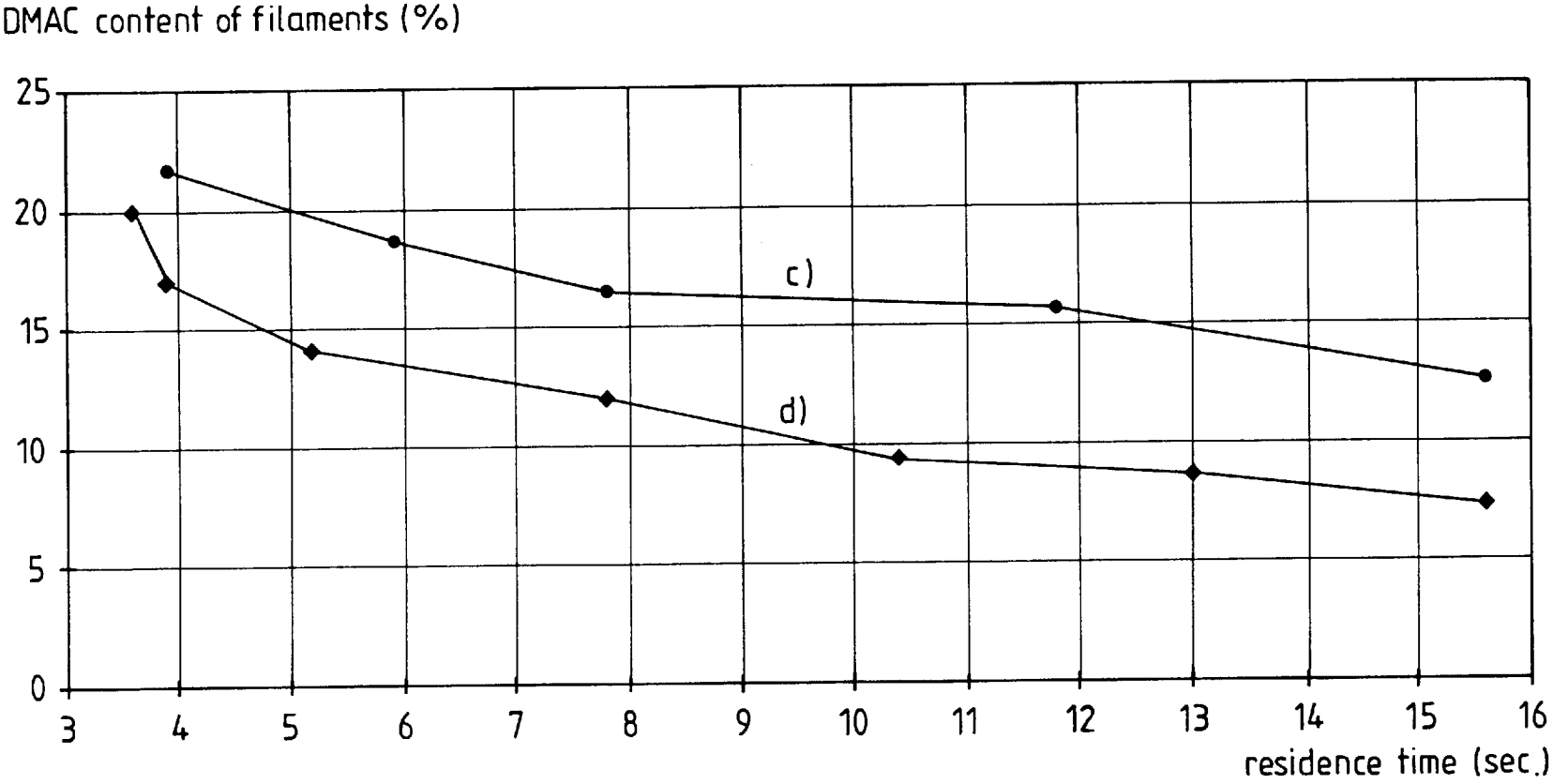
FIG. 3 shows the residual solvent content (DMAC) of two elastane filaments treated according to the invention as a function of residence time.

Of course, different residual DNIAC contents specific to each titre are found in the elastane filaments after washing. This is due to different process parameters (different precipitation bath concentration, different pull-off speed, etc.). For example, a titre of 160 dtex can be spun better from a precipitation bath containing 12% DMAC instead of 20% DMAC as is used for a titre of 550 dtex (see Example 1). FIG. 3*d* shows the residual DMAC contents of elastane filaments of titre 160, and FIG. 3*c* shows the residual DMAC contents of elastane filaments of titre 550 dtex, for different washing periods at a washing temperature of 91° C. and without the use of the washing section according to the invention. It can be stated quite generally that the coarser the titre is the higher is the residual solvent content of the elastane filaments after washing.

The process according to the invention is independent of titre, however, and can be employed for the entire range of titres used in wet-spinning, preferably over the range of 20 to 2500 dtex or more.

We claim:

1. An apparatus for washing elastane filaments as part of a continuous wet-spinning device comprising a wet-spinning unit, a precipitation bath 1, a washing section, and an after-treatment section, said washing section consisting of at least one stripping unit 10 comprising a deflection roller 3, a squeezing roller 4 and a scraper 5, wherein freshly wet-spun elastane filaments are substantially freed, on the stripping unit 10, from adhering water which is dragged out of the precipitation bath, wherein stripped-off water flows back into the precipitation bath, and a washing unit 11 comprising washing rollers 6, 8, a washing vat 9 and an additional squeezing roller 7, wherein the stripping unit 10 and the washing unit 11 are disposed in steps above the precipitation bath 1 of the wet-spinning device and the elastane filaments 12 leaving the precipitation bath are fed to the washing unit 11 via the stripping unit 10 and thence are fed to the further after-treatment section.

2. An apparatus according to claim 1, wherein the squeezing roller 7 on the washing roller 6 of the washing bath 9 only covers the width of the elastane filament warp which leaves the washing roller in the direction of the after-treatment section.

3. An apparatus according to claim 1, wherein the Shore hardness of the squeezing rollers 4 and 7 is 60 to 80 and the contact pressure of the squeezing rollers 4 and 7 is at least 1.5N per cm of roller width.

4. An apparatus according to claim 1, wherein the spinning solvent for the elastane filaments is dimethyl acetamide.

5. An apparatus according to claim 1, wherein the after-treatment section comprises a fixer, a drier, a preparation point and a winding device.

6. A process for washing elastane filaments from a continuous wet-spinning process using an apparatus comprising a wet-spinning unit having a precipitation bath 1 and a washing section consisting of at least one stripping unit 10 comprising a deflection roller 3, a squeezing roller 4 and a scraper 5, and a washing unit 11 comprising washing rollers 6, 8, a washing vat 9 and an additional squeezing roller 7, wherein the stripping unit 10 and the washing unit 1 1 are disposed in steps above the precipitation bath 1 of the wet-spinning device wherein freshly wet-spun elastane filaments are pulled off at a pull-off speed of at least 50 m/min and are substantially freed, on the stripping unit 10, from adhering water which is dragged out of the precipitation bath, wherein stripped-off water flows back into the precipitation bath, and are freed from at least 30% of the spinning solvent by multiple immersions in the washing liquid at a temperature of at least 90° C. in the subsequent washing unit 11, and optionally thence feeding the elastane filaments to a further after-treatment section.

7. A process according to claim 6, wherein the squeezing roller 7 only covers the width of the elastane filament warp which leaves the washing roller in the direction of the after-treatment section.

8. A process according to claim 6, wherein the squeezing rollers have a Shore hardness of 60 to 80 and the contact pressure of the squeezing rollers 4 and 7 is at least 1.5N per cm. of roller width.

9. A process according to claim 6, wherein the spinning solvent for the elastane filaments is dimethyl acetamide.

10. A process according to claim 6, wherein the after-treatment section comprises a fixer, a drier, a preparation point and a winding device.

* * * * *

UNITED STATES PATENT AND TRADEMARK OFFICE

CERTIFICATE OF CORRECTION

PATENT NO. : 5,813,068

DATED : September 29, 1998

INVENTOR(S) : Reinehr, et al.

It is certified that error appears in the above-identified patent and that said Letters Patent is hereby corrected as shown below:

| | |
|---|---|
| Title Page [54] Title and Col.1, Line 3 | After "Elastane" insert --Filaments-- |
| Title Page [56] US Patent Documents | Delete "256,923 5/1882" and substitute --2,156,923 5/1939-- |

Signed and Sealed this

Twenty-fourth Day of August, 1999

*Attest:*

*Attesting Officer*

Q. TODD DICKINSON

*Acting Commissioner of Patents and Trademarks*